US010524559B2

(12) United States Patent
Rutigliano et al.

(10) Patent No.: US 10,524,559 B2
(45) Date of Patent: Jan. 7, 2020

(54) APPLICATOR FOR A COSMETIC PRODUCT AND ASSOCIATED APPLICATOR ASSEMBLY

(71) Applicant: ALBEA SERVICES, Gennevilliers (FR)

(72) Inventors: Anne Rutigliano, Maisons-Laffitte (FR); Camille Schreiber, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 598 days.

(21) Appl. No.: 15/091,875

(22) Filed: Apr. 6, 2016

(65) Prior Publication Data

US 2016/0295996 A1 Oct. 13, 2016

(30) Foreign Application Priority Data

Apr. 9, 2015 (FR) ..... 15 53084

(51) Int. Cl.
*A45D 40/26* (2006.01)
*A46B 9/02* (2006.01)
*A45D 34/04* (2006.01)

(52) U.S. Cl.
CPC ..... *A45D 40/267* (2013.01); *A45D 34/042* (2013.01); *A45D 34/046* (2013.01); *A45D 40/262* (2013.01); *A46B 9/021* (2013.01); *A46B 2200/1053* (2013.01)

(58) Field of Classification Search
CPC ..... A45D 40/262–268; A45D 34/042–046; A46B 9/021; A46B 2200/1053; A46B 2200/106
USPC ..... 132/218; 401/129
See application file for complete search history.

(56) References Cited

U.S. PATENT DOCUMENTS

| | | | | |
|---|---|---|---|---|
| 4,404,977 | A * | 9/1983 | Vasas | A45D 40/267 132/218 |
| 5,165,760 | A * | 11/1992 | Gueret | A46B 3/18 300/21 |
| D652,628 | S * | 1/2012 | Thierer | D4/128 |
| 9,370,234 | B2 * | 6/2016 | Lhoyer | A46B 9/021 |
| 9,526,316 | B2 * | 12/2016 | Pires | A45D 40/262 |
| 2009/0014022 | A1 * | 1/2009 | Salciarini | A45D 40/265 132/200 |

(Continued)

FOREIGN PATENT DOCUMENTS

| | | |
|---|---|---|
| EP | 2196106 | 6/2010 |
| FR | 2512653 | 3/1983 |

(Continued)

OTHER PUBLICATIONS

FR Appln 1553084, Written Opinion, dated Apr. 9, 2015.
FR Appln 1553084, International Search Report, dated Jan. 25, 2016.

*Primary Examiner* — Tatiana L Nobrega
(74) *Attorney, Agent, or Firm* — Banner & Witcoff, Ltd.

(57) ABSTRACT

Applicator for a cosmetic product, in particular for mascara, comprising:

a core that extends along a main longitudinal axis of extension X and has two ends;

a plurality of protrusion that project from the core and are moulded to the core.

Said applicator is characterised in that the core has a plurality of recessed regions for storing product, which alternate, axially along the axis X of said core, with jutting regions for combing the eyelashes, said recessed regions consisting of cylindrical portions.

12 Claims, 2 Drawing Sheets

(56) References Cited

U.S. PATENT DOCUMENTS

| | | | | |
|---|---|---|---|---|
| 2012/0060859 | A1* | 3/2012 | Wyatt | A46B 1/00 132/218 |
| 2013/0276812 | A1* | 10/2013 | Kulik | A45D 40/262 132/218 |
| 2015/0110541 | A1* | 4/2015 | Uresti | A46B 3/005 401/129 |
| 2017/0231367 | A1* | 8/2017 | Skert | A46B 9/021 15/160 |

FOREIGN PATENT DOCUMENTS

| | | |
|---|---|---|
| FR | 2637472 | 4/1990 |
| FR | 2918547 A1 | 1/2009 |

* cited by examiner

APPLICATOR FOR A COSMETIC PRODUCT AND ASSOCIATED APPLICATOR ASSEMBLY

CROSS REFERENCE TO RELATED APPLICATIONS

This application claims priority to French Application Serial No. 1553084, filed Apr. 9, 2015, which is hereby incorporated by reference in its entirety.

FIELD OF THE INVENTION

The invention relates to a cosmetic product applicator and to an associated applicator assembly.

BACKGROUND

Applicator assemblies for cosmetic products, in particular for cosmetic products to be applied to the eyelashes, such as mascara, comprising a receptacle that holds the cosmetic product and an applicator capable of being removably attached to the receptacle, are known.

The receptacle generally comprises a body, the body comprising walls delimiting a container in which the cosmetic product is held, and a neck defining an opening through which the cosmetic product can be removed.

The applicator assembly generally comprises a cap suitable for being attached to the neck, a rod extending from the cap, and an applicator attached to a free end of the rod. The applicator comprises a core and a plurality of protrusions extending from the core.

When the cap is attached to the neck, the rod and the applicator extend within the container. The applicator is immersed in the cosmetic product held in the container.

To use the applicator, the user detaches the cap from the neck and removes the applicator from the receptacle.

It is known to produce applicators by means of moulding. One advantage of moulded applicators is that they permit significant levels of freedom, particularly in terms of shape. They can be moulded by injection-moulding plastics material, and are thus commonly referred to as "plastics brushes".

SUMMARY OF THE INVENTION

An object of the present invention is to propose an applicator having moulded protrusions for obtaining different make-up effects.

The invention thus relates to an applicator for a cosmetic product, in particular for mascara, comprising:

- a core that extends along a main longitudinal axis of extension X and has two ends;
- a plurality of protrusions that project from the core and are moulded to the core.

Said applicator is mainly characterised in that the core has a plurality of recessed regions for storing product, which alternate, axially along the axis X of said core, with jutting regions for combing eyelashes, the recessed regions consisting of cylindrical portions.

The plastics brush of the invention thus proposes a distinctive structure of the core that provides specific advantages for dispensing mascara all the way along the brush, for example in terms of functions such as loading or combing. This arrangement improves the effects of thickening the eyelashes, lengthening the eyelashes and/or separating the eyelashes, as brought about when mascara is applied by means of the brush of the invention.

Having cylindrical portions allows large loading regions to be created, as opposed to narrow grooves in the prior art.

According to different embodiments of the invention, which can be taken together or separately:

- the core consists of a series of spherical portions corresponding to the jutting regions, which alternate with the cylindrical portions corresponding to the recessed regions, product storage regions being located around the cylindrical portions;
- all the spherical portions have identical dimensions;
- all the cylindrical portions have identical dimensions;
- the applicator has an outer envelope and an inner envelope interleaved with one another, said envelopes being formed by the free ends of the protrusions, the inner envelope having, starting from the axis of extension X, a radial extension that is smaller than the radial extension of the outer envelope;
- the inner envelope and outer envelope are notched along the axis X, having indentations and raised areas located at the recessed regions and jutting regions, respectively, of the core;
- the ratio of the diameter defined by the outer envelope between the recessed regions and the jutting regions is between 0.55 and 0.85, preferably 0.75;
- the ratio of the diameter defined by the inner envelope between the recessed regions and the jutting regions is between 0.75 and 0.95, preferably 0.85;
- the protrusions on the inner envelope and outer envelope are distributed in longitudinal lines substantially in parallel with the axis X;
- one on two of the lines of protrusions forms the inner envelope, the other line of protrusions forming the outer envelope;
- said protrusions are all at an angle to a direction perpendicular to the axis X;
- no protrusion is at an angle perpendicularly to the axis X;
- all the protrusions of one line are tilted at the same angle;
- the protrusions that form the outer envelope are tilted towards a first end of the core, referred to as the distal end, and the protrusions that form the inner envelope are tilted towards a second, free end of the core, referred to as the proximal end;
- starting from a base located at the core up to their free end, the protrusions that form the outer envelope are of a greater length than the protrusions that form the inner envelope;
- the adjacent lines are staggered relative to one another in the direction of the axis X;
- said lines are radially spaced around the periphery of the core at a constant angular distance;
- the protrusions each have a planar surface;
- the protrusions are positioned such that planar surfaces of two adjacent protrusions are oriented in the same rotational direction;
- each protrusion is in the shape of a half-cone, the diameter of which reduces towards the free end thereof;
- each protrusion ends in a protuberance at the free end thereof;
- each protrusion ends in a hemispherical protuberance at the free end thereof;
- the protrusions forming the outer envelope are connected to the cylindrical portions by means of a stiffening rail.

The invention also relates to a cosmetic product applicator assembly, comprising:

- a receptacle having a body which forms a container intended to hold a cosmetic product, and an applicator according any of the preceding claims, suitable for being attached to the receptacle such that the applicator is accommodated inside the container.

DESCRIPTION OF THE DRAWINGS

Other features and advantages will become clearer from the following description, which is merely illustrative and non-limiting and should be read with reference to the accompanying drawings, in which.

DETAILED DESCRIPTION

Figure 1:
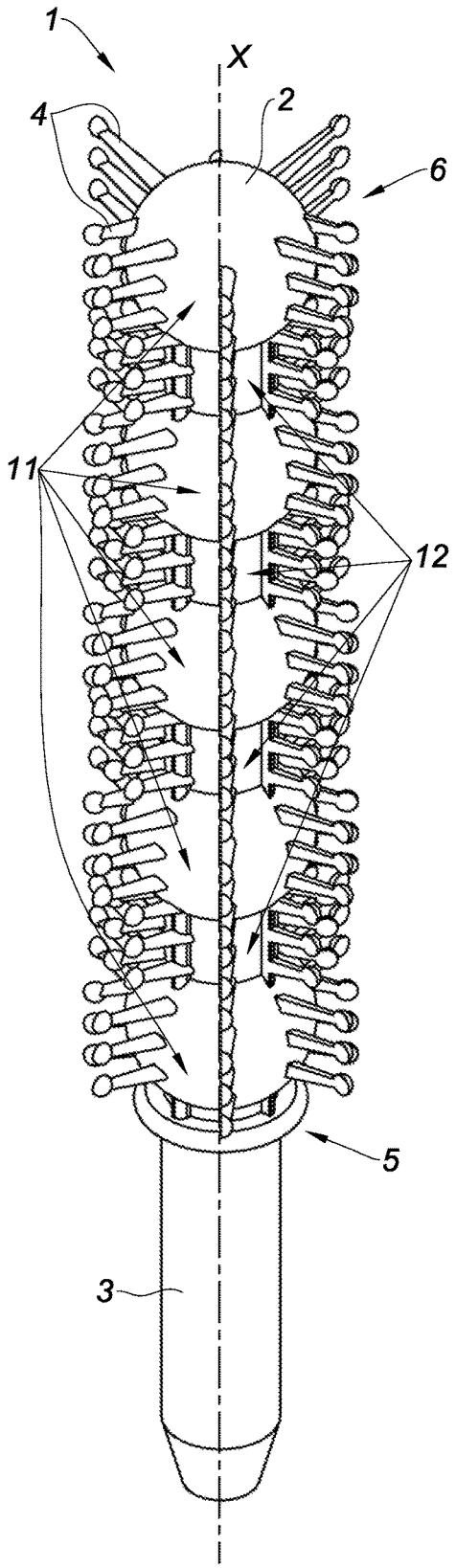
FIG. 1 is a slightly tilted perspective view of an applicator according to the invention.

The invention relates to an applicator 1 for a cosmetic product, in particular for mascara, comprising a core 2 extending in a main longitudinal direction of extension, referred to as the axis of extension and denoted by X in FIG. 1.

The core 2 has a first end, referred to as a proximal end 5, which is capable of being attached to an applicator rod (not shown) by means of a cylindrical coupling 3 that extends said core 2, and a second, free end, referred to as a distal end 6.

The applicator 1 further comprises a plurality of protrusions 4 projecting from the core 2 in substantially radial directions in relation to the axis of extension X. Each protrusion 4 has a base located at the core 2 and a free end. Said cylindrical coupling 3 does not have any protrusions.

Furthermore, the associated applicator assembly comprises a receptacle (not shown). According to the invention, said receptacle generally comprises a wiper which is attached to the interior of the neck thereof in order to limit the amount of product on the protrusions 4 when the applicator passes therethrough.

Advantageously, the applicator 1 forms a brush that is suitable for being coated with product.

The protrusions 4 are preferably integrally formed with the core 2. The core 2 and the protrusions 4 may thus be moulded from a material based on LDPE (low-density polyethylene). Other materials can be used, namely the material "EXACT" from ExxonMobil or the material "HYTREL" from Dupont, or a mixture of these materials. The protrusions 4 are thus all made of the same material.

The core 2 according to the invention does not have a constant cross section. Indeed, the core 2 is formed by superposing jutting regions for combing the eyelashes, which are formed by spherical portions 11, alternately with recessed regions for storing product, which are formed by cylindrical portions 12. In the example shown, the core 2 comprises five spherical portions 11 and four cylindrical portions 12. The proximal end 5 and distal end 6 of the core 2 are formed by a spherical portion 11.

Figure 5:
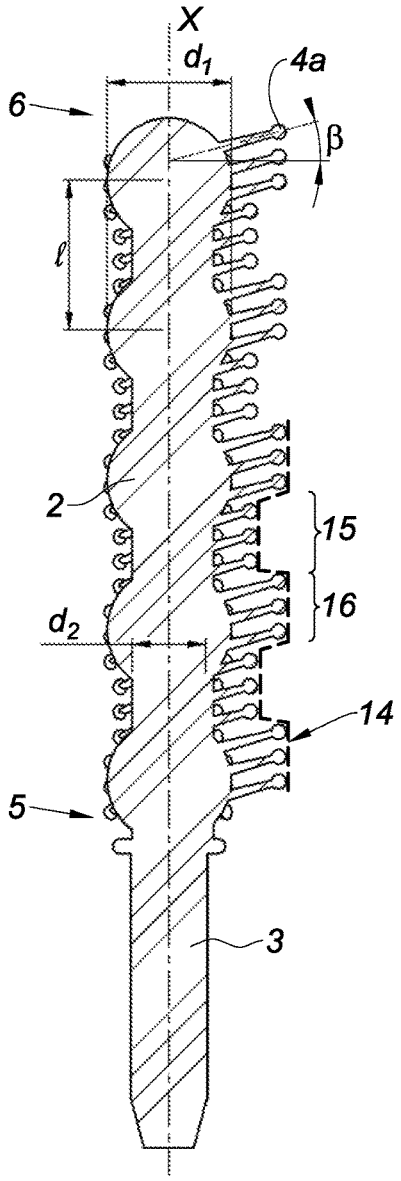
FIG. 5 is a cross section along the axis A-A shown in FIG. 4.

As shown in FIG. 5, the distance l between two spherical portions 11 is the same all the way along the axis X of the core 2. This distance l is between 4 and 6 mm, preferably 5.1 mm. The length of a spherical portion 11 corresponds approximately to double the length of a cylindrical portion 12.

The spherical portions 11 have a maximum diameter d1 that is more than the diameter d2 of the cylindrical portions 12. The minimum diameter of the spherical portions 11 corresponds to the diameter d2 of the cylindrical portions 12. Advantageously, the maximum diameter d1 of the spherical portions 11 substantially corresponds to the diameter of the wiper of the receptacle.

Therefore, when the core 2 is wiped, the product loaded around the spherical portions 11 is removed into the receptacle, while the product loaded around the cylindrical portions 12 remains stored thereon, advantageously forming a product store at each cylindrical portion 12.

Figure 3:
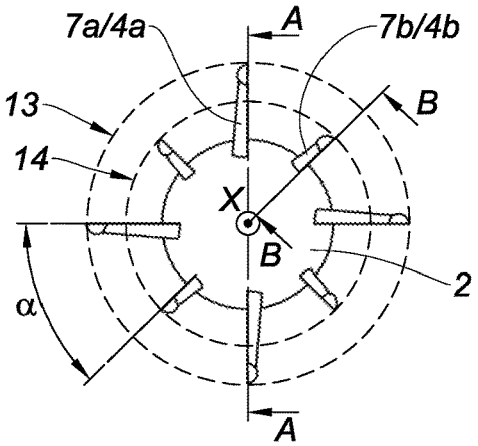
FIG. 3 is a plan view of the applicator according to FIG. 1.

The free ends of the protrusions 4 form an outer envelope 13 and an inner envelope 14, which are interleaved with one another and are shown in particular in FIG. 3 in the plan view of the applicator 1. The radial extension of the inner envelope 14, starting from the axis X, is smaller than the radial extension of the outer envelope 13.

Figure 4:
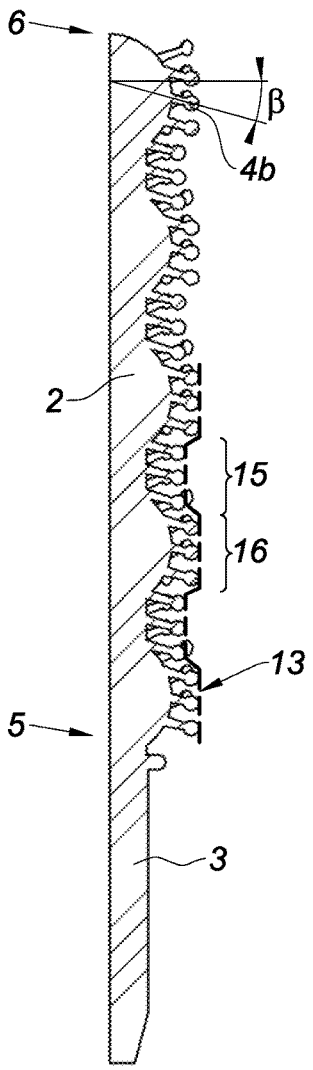
FIG. 4 is a cross section along the axis B-B shown in FIG. 3.

Said envelopes 13, 14 have a circular cross section, the diameter of which increases when passing through a spherical portion 11 and reduces when passing through a cylindrical portion 12. Said envelopes 13, 14 are thus wave-like in the direction of the axis X. More specifically, said envelopes 13, 14 are notched and have indentations 15 at the cylindrical portions 12 and raised areas 16 at the spherical portions 11, as shown in FIGS. 4 and 5.

Advantageously, said indentations 15 located around the cylindrical storage portions 12 thus give the user easy access to the product storage regions in order to be able to load the eyelashes. Once loaded, the eyelashes can be combed owing to the protrusions 4 forming the raised areas.

The combination of having the product storage regions on the core 2 and the presence of indentations 15 for making it easier to access the product is extremely advantageous.

The average diameter of the outer envelope 13 (or inner envelope 14) at a jutting region 11 is for example 7.9 mm (or 6 mm, respectively).

The average diameter of the outer envelope 13 (or inner envelope 14) at a recessed region 12 is for example 6 mm (or 5.1 mm, respectively).

The ratio of the diameter defined by the outer envelope 13 between the recessed regions 12 and the jutting regions 11 is between 0.55 and 0.85, preferably 0.75.

The ratio of the diameter defined by the inner envelope 14 between the recessed regions 12 and the jutting regions 11 is between 0.75 and 0.95, preferably 0.85.

Figure 2:
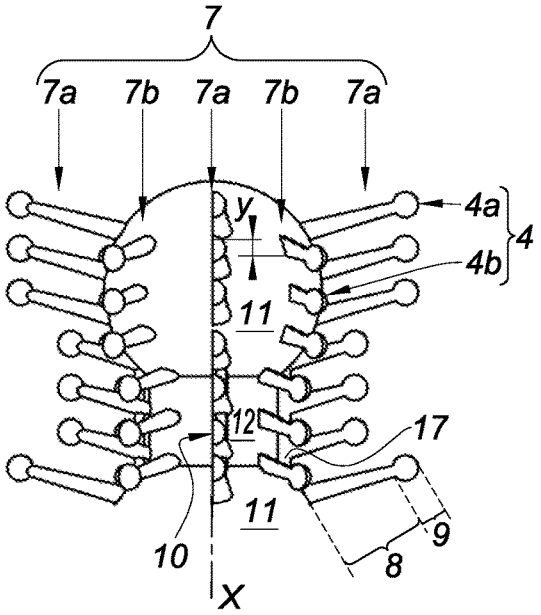
FIG. 2 is an enlarged front view of the free end of the applicator according to FIG. 1.

As shown in FIG. 2, the protrusions 4 are arranged in a plurality of lines 7 which extend in parallel with the direction of the axis X. The adjacent lines 7*a*, 7*b* are offset from one another in the direction of the axis X. The protrusions 4 are thus staggered relative to one another. FIG. 2 shows the offset here between the bases of two proximal protrusions 4*a*, 4*b* belonging to adjacent lines 7*a*, 7*b*. This staggered position prevents the formation of local accumulations, when the ideal is to have uniform distribution of the product between the lines 7 and between the protrusions 4. The uniform distribution of the protrusions 4 with said offset between the lines 7 thus promotes the uniform distribution of the product on the applicator 1, and thus on the eyelashes of the user.

In the same way, the lines 7 are radially spaced around the periphery of the core 2 at a constant angular distance $\alpha$, which also promotes the uniform distribution of the product on the applicator 1. As shown in FIG. 3, the angular sector a between two adjacent lines 7*a*, 7*b* is constant all the way around the core 2. The brush preferably comprises twelve lines 7 of protrusions 4, each spaced at an angle α of 30°.

According to the invention, one on two 7*a* of the lines is involved in forming the outer envelope 13, and the other 7*b* is involved in forming the inner envelope 14. The protrusions 4*a* belonging to the lines 7*a* forming the outer envelope 13 have a length, measured from a base starting from the core 2 up to a free end, that is greater than the protrusions 4*b* belonging to the lines 7*b* forming the inner envelope 14.

The protrusions 4*a* that form the outer envelope 13 are joined to the cylindrical portions 12 by stiffening rails 17 so as to make them less flexible in the product storage regions, in order to make it easier to load the product on the eyelashes.

The protrusions 4 of one line 7 have several lengths, in order to create the indentations 15 and the raised areas 16 of the corresponding envelope 13, 14, depending on the variable diameter of the core 2.

The present invention has another special detail in that the protrusions 4 on the applicator 1 are all at an angle to a direction perpendicular to the axis X. More specifically, all the protrusions 4 of one line 7 are tilted at the same angle. The protrusions 4*a* of the lines 7*a* forming the outer envelope 13 are tilted towards the distal end 6 of the core 2, while the protrusions 4*b* of the lines 7*b* forming the inner envelope 14 are tilted towards the proximal end 5 of the core 2. Therefore, the protrusions 4*a*, 4*b* of two adjacent lines 7*a*, 7*b* are tilted at different angles.

These tilts towards the proximal end 5 and towards the distal end 6 are shown in particular in FIGS. 4 and 5, respectively. In the selected example, the tilt angle β of the protrusions 4*b*, 4*a* forming the inner envelope 14 and of those forming the outer envelope 13 is negative and positive, respectively, relative to a straight line perpendicular to the axis X, and has the same value of approximately 15°.

The advantage provided by these tilts and length variations of the protrusions 4 becomes apparent when applying the mascara to the eyelashes. Indeed, the protrusions 4*b* that are directed away from the free end 6 of the brush and define the inner envelope 14 allow for simple access to the product storage regions on the brush and allow the product to be loaded onto the eyelashes, while the protrusions 4*a* that are directed towards the free end 6 of the brush and form the outer envelope 13 follow the general movement of the brush when makeup is applied, and grip and extend the eyelashes in order to optimally spread the product on the eyelashes and to comb them at the same time. This creates an effect of lengthening the eyelashes. The distribution of said protrusions 4 in lines 7 improves performance when separating the eyelashes, which thus adds to the lengthening of the eyelashes.

On the other hand, in order to simplify the processes for producing such an applicator 1, the protrusions 4 may have a semi-circular cross section. In this way, they preferably each have a planar surface 10. In this case, said protrusions 4 are positioned such that the planar surfaces 10 of two adjacent protrusions 4 are oriented in the same rotational direction around the core 2, as shown in FIGS. 2 and 3.

In addition, the protrusions 4 are preferably in the shape of a half-cone 8, the diameter of which reduces towards the free end thereof and ends in a hemispherical shape 9 at the free end thereof. This hemisphere 9 allows the brush to get a better grip on the eyelash.

It should also be noted that the core 2 is solid. However, said core can be hollow, without departing from the scope of the invention.

By way of reminder, the invention also relates to an applicator assembly for a cosmetic product, comprising a receptacle (not shown) having a body which forms a container holding the cosmetic product, and an applicator 1 as described above that is capable of being attached to the receptacle such that the applicator 1 is accommodated within the container. Said applicator 1 is attached, for example, to the end of a rod (not shown), the rod itself being attached to a cap (not shown) that is advantageously screwed to the receptacle. After assembly, the cylindrical coupling 3 is positioned in the rod and the proximal end 5 of the core 2 forms the visible proximal end of the applicator 1.

The invention claimed is:

1. An applicator for a cosmetic product, comprising:

a core that is solid, extends along a main longitudinal axis of extension (X), and has a distal end and a proximal end;

a plurality of protrusions that project from the core and are integrally formed with the core;

wherein the core has a plurality of recessed regions for storing product, which alternate, axially along the axis (X) of said core, with jutting regions for combing the eyelashes, said recessed regions comprising cylindrical portions; and wherein the core comprises a series of spherical portions corresponding to the jutting regions, which alternate with the cylindrical portions corresponding to the recessed regions, product storage regions being located around the cylindrical portions;

the applicator further comprising:

an outer envelope and an inner envelope interleaved with one another, said envelopes being formed by free ends of the protrusions, the inner envelope having, starting from the axis of extension (X), a radial extension that is smaller than the radial extension of the outer envelope;

wherein the inner envelope and outer envelope are notched along the axis (X), having indentations and raised areas located at the recessed regions and jutting regions, respectively of the core;

wherein the protrusions on the inner envelope and outer envelope are distributed in longitudinal lines substantially in parallel with the axis (X); and wherein the longitudinal lines of the protrusions forming the inner envelope alternate with the longitudinal lines of protrusions forming the outer envelope.

2. The applicator according to claim 1, wherein the ratio of the diameter defined by the outer envelope between the recessed regions and the jutting regions is between 0.65 and 0.85.

3. The applicator according to claim 2, wherein the ratio of the diameter defined by the inner envelope between the recessed regions and the jutting regions is between 0.75 and 0.95.

4. The applicator according to claim 1, wherein said protrusions are all at an angle to a direction perpendicular to the axis (X).

5. The applicator according to the claim 4, wherein all the protrusions of one longitudinal line are at the same angle.

6. The applicator according to claim 5, wherein the protrusions that form the outer envelope are tilted towards the distal end of the core, and the protrusions that form the inner envelope are tilted towards the proximal end of the core, which is a free end of the core.

7. The applicator according to claim 6, wherein, starting from a base located at the core up to the proximal end, the protrusions that form the outer envelope are of a greater length than the protrusions that form the inner envelope.

8. The applicator according to claim 1, characterised in that adjacent longitudinal lines are staggered relative to one another in the direction of the axis (X).

9. The applicator according to claim 1, wherein said lines are radially spaced around the periphery of the core at a constant angular distance.

10. Applicator according to claim 1, wherein the ratio of the diameter defined by the outer envelope between the recessed regions and the jutting regions is 0.75.

11. Applicator according to claim 2, wherein the ratio of the diameter defined by the inner envelope between the recessed regions and the jutting regions is 0.85.

12. An applicator assembly for a cosmetic product, comprising:

a receptacle comprising a body which forms a container intended to hold the cosmetic product, and an applicator according to claim 1, suitable for being attached to the receptacle such that the applicator is accommodated inside the container.

* * * * *